US006962010B2

(12) United States Patent
Huff

(10) Patent No.: US 6,962,010 B2
(45) Date of Patent: Nov. 8, 2005

(54) DRESS SHOE WITH IMPROVED HEEL COUNTER

(75) Inventor: Marvin Huff, Parsippany, NJ (US)

(73) Assignee: Footstar Corporation, Mahwah, NJ (US)

( * ) Notice: Subject to any disclaimer, the term of this patent is extended or adjusted under 35 U.S.C. 154(b) by 104 days.

(21) Appl. No.: 10/262,571

(22) Filed: Oct. 2, 2002

(65) Prior Publication Data

US 2004/0064975 A1 Apr. 8, 2004

(51) Int. Cl.[7] ..... A43B 23/16

(52) U.S. Cl. ..... 36/69; 36/93

(58) Field of Search ..... 36/68, 69, 92, 36/93

(56) References Cited

U.S. PATENT DOCUMENTS

| | | | | |
|---|---|---|---|---|
| 2,720,042 A | * | 10/1955 | Marcy | 36/68 |
| 4,490,928 A | | 1/1985 | Kawashima | 36/69 |
| 4,513,518 A | | 4/1985 | Jalbert et al. | 36/44 |
| 4,541,186 A | | 9/1985 | Mulvihill | 36/114 |
| 4,581,187 A | | 4/1986 | Sullivan et al. | 264/46.4 |
| 4,586,273 A | | 5/1986 | Chapnick | 36/44 |
| 4,590,123 A | | 5/1986 | Hashimoto et al. | 428/316.6 |
| 4,590,689 A | | 5/1986 | Rosenberg | 36/3 B |
| 4,627,178 A | | 12/1986 | Sullivan et al. | 36/44 |
| 4,633,598 A | | 1/1987 | Moronaga et al. | 36/44 |
| 4,638,576 A | | 1/1987 | Parracho et al. | 36/68 |
| 4,651,445 A | | 3/1987 | Hannibal | 36/103 |
| 4,674,204 A | | 6/1987 | Sullivan et al. | 36/44 |
| 4,694,589 A | | 9/1987 | Sullivan et al. | 36/44 |
| 4,731,939 A | | 3/1988 | Parracho et al. | 36/31 |
| 4,782,605 A | | 11/1988 | Chapnick | 36/44 |
| 4,805,319 A | | 2/1989 | Tonkel | 36/28 |
| 4,808,469 A | | 2/1989 | Hiles | 428/318.6 |
| 4,815,221 A | | 3/1989 | Diaz | 36/27 |
| 4,821,430 A | * | 4/1989 | Flemming et al. | 36/69 |
| 4,823,483 A | | 4/1989 | Chapnick | 36/43 |
| 4,893,418 A | | 1/1990 | Ogden | 36/44 |
| 4,910,886 A | | 3/1990 | Sullivan et al. | 36/44 |
| 4,918,776 A | | 4/1990 | Motoda | 12/142 |
| 4,925,724 A | | 5/1990 | Ogden | 428/137 |
| 4,942,679 A | | 7/1990 | Brandon et al. | 36/102 |
| 5,101,580 A | | 4/1992 | Lyden | 36/93 |
| 5,105,564 A | | 4/1992 | Motoda | 36/43 |
| 5,203,793 A | | 4/1993 | Lyden | 36/88 |
| 5,275,775 A | | 1/1994 | Riecken | 264/222 |
| 5,311,677 A | | 5/1994 | Mann et al. | 36/107 |
| 5,325,611 A | | 7/1994 | Dyer et al. | 36/30 |
| 5,388,349 A | | 2/1995 | Ogden | 36/43 |
| 5,463,824 A | | 11/1995 | Barna | 36/44 |
| 5,544,432 A | | 8/1996 | Kita | 36/43 |
| 5,564,989 A | | 10/1996 | Larsen | 473/217 |
| 5,584,130 A | | 12/1996 | Perron | 36/44 |
| 5,604,998 A | * | 2/1997 | Kita | 36/69 |
| 5,607,745 A | | 3/1997 | Ogden | 428/138 |
| 5,669,162 A | | 9/1997 | Dyer | 36/44 |
| 5,675,914 A | | 10/1997 | Cintron | 36/3 B |
| 5,714,229 A | | 2/1998 | Ogden | 428/138 |
| 5,718,063 A | | 2/1998 | Yamashita et al. | 36/28 |

(Continued)

OTHER PUBLICATIONS

Rogers Corporation promotional advertising for PORON performance cushioning materials, undated.

*Primary Examiner*—Ted Kavanaugh
(74) *Attorney, Agent, or Firm*—Ohlandt, Greeley, Ruggiero & Perle L.L.P.

(57) ABSTRACT

A comfortable heel counter for a dress shoe is provided. The dress shoe includes an upper that has a first portion and a second portion. The first portion is connected to the second portion to define a heel counter pocket. A heel counter insert is disposed between the first portion and the second portion in the heel counter pocket. The heel counter insert is disposed in spaced relation to a calcaneus bone of a wearer. The heel counter insert provides comfort to the wearer and an improved fitting of the dress shoe.

24 Claims, 2 Drawing Sheets

U.S. PATENT DOCUMENTS

| | | | | | |
|---|---|---|---|---|---|
| 5,718,064 | A | | 2/1998 | Pyle | 36/28 |
| 5,724,753 | A | | 3/1998 | Throneburg et al. | 36/91 |
| 5,727,336 | A | | 3/1998 | Ogden | 36/43 |
| 5,782,014 | A | | 7/1998 | Peterson | 36/38 |
| 5,799,414 | A | | 9/1998 | Kellerman | 36/44 |
| 5,829,171 | A | | 11/1998 | Weber et al. | 36/93 |
| 5,994,245 | A | | 11/1999 | Marier et al. | 442/373 |
| 6,000,147 | A | | 12/1999 | Kellerman | 36/44 |
| 6,079,128 | A | * | 6/2000 | Hoshizaki et al. | 36/89 |
| 6,120,880 | A | | 9/2000 | Crow | 428/167 |
| 6,125,557 | A | | 10/2000 | Brown | 36/144 |
| 6,127,010 | A | | 10/2000 | Rudy | 428/35.7 |
| 6,195,917 | B1 | | 3/2001 | Dieckhaus | 36/44 |
| 6,205,685 | B1 | | 3/2001 | Kellerman | 36/44 |
| 6,269,555 | B1 | | 8/2001 | Brown | 36/144 |
| 6,280,815 | B1 | | 8/2001 | Ersfeld et al. | 428/71 |
| 6,286,232 | B1 | | 9/2001 | Snyder et al. | 36/43 |
| 6,301,805 | B1 | | 10/2001 | Howlett et al. | 36/43 |
| 2001/0001351 | A1 | | 5/2001 | Dieckhaus | 36/44 |
| 2001/0001904 | A1 | | 5/2001 | Hernandez | 36/28 |
| 2002/0007569 | A1 | | 1/2002 | Crane et al. | 36/44 |

* cited by examiner

DRESS SHOE WITH IMPROVED HEEL COUNTER

BACKGROUND OF THE INVENTION

1. Field of the Invention

The present invention relates to dress shoes. More particularly, the present invention relates to a dress shoe having a heel counter insert for improved comfort and fitting.

2. Description of the Prior Art

Cushioning materials disposed in the foot bed of an athletic shoe are known in the art. Today's consumer requires increased comfort in all types of shoes including boots, athletic shoes, moccasins and sneakers. Typically, the cushioning material is disposed in a foot bed, an insole cushion or a tongue of the shoe, or take the form of one or more inserts. The cushioning materials can range from foam, polyurethane, thermoplastics or leather. Typically, the cushioning material is disposed in the insole cushion or more specifically in the heel strike where the maximum amount of force is concentrated when the user is walking or running. The cushioning is limited exclusively to the underneath surface of the foot, where the metatarsals of the foot contact ground.

The prior art has been focused on cushioning materials in only certain classes of shoes, for instance sneakers, cross-training shoes and athletic shoes. However few, if any, shoes have focused on the use of cushioning materials in the upper or more specifically the heel counter of the shoe.

One attempt in the art is illustrated in U.S. Pat. No. 4,541,186 to Mulvihill. Mulvihill provides a gymnastic shoe with a cushioning and shock-absorbing insert. In addition to an insert, Mulvihill provides a gymnastic shoe having a rigid heel counter to add stability and protection to the heel area of the shoe and to provide a degree of control to rear foot motion. The counter member is made from a rigid material that is molded to the shape of the heel area of the upper of the gymnastic shoes. However, given the nature of the molded material used, any benefit obtained from a rigid material is outweighed by the detriments attributed to the poor fit of the shoe. Any molded material, especially when used in a dress shoe, placed behind the foot can potentially push or otherwise crowd the foot forward toward the forefoot. This crowding leads to an uncomfortable fit of the shoe since the overall size of the shoe is reduced. The size is reduced because the thickness of the rigid molded heel counter or size of the upper decreases the available space in the interior of the dress shoe.

Therefore, in view of the shortcomings of the prior art, what is heretofore needed is a comfortable heel counter for a dress shoe. Thus, there is a need for a dress shoe that includes a heel counter insert is disposed in spaced relation to a calcaneus bone of a wearer. The heel counter insert provides comfort to the wearer and improved fitting of the dress shoe.

SUMMARY OF THE INVENTION

It is an object of the present invention to a provide a dress shoe having a heel counter insert.

It is another object of the present invention that the heel counter insert is disposed in spaced relation to a calcaneus bone of a wearer.

It is still another object of the present invention that the heel counter insert provides comfort to the wearer and improved fitting of the dress shoe.

It is yet another object of the present invention to provide a dress shoe having a first portion and a second portion that both form the upper and surround the outer periphery of a heel of the wearer.

It is still another object of the present invention to provide a dress shoe, in which the heel counter insert is made of one or more of the following materials: Poron, a polyurethane, an ethyl vinyl acetate, a slow recovery polyurethane, and a slow recovery ethyl vinyl acetate.

It is still a further object of the present invention to provide a dress shoe in which the heel counter insert has a thickness in a range of about 1 mm to about 3 mm.

The above and other objects, advantages, and benefits of the present invention will be understood by the present invention that is a dress shoe. The dress shoe includes an upper with a first portion and a second portion. The first portion is connected to the second portion to define a heel counter pocket. The first portion and the second portion are connected to a foot bed. The heel counter insert is disposed between the first portion and the second portion in spaced relation to a calcaneus bone of the wearer.

DESCRIPTION OF THE PREFERRED EMBODIMENT

Figure 1:
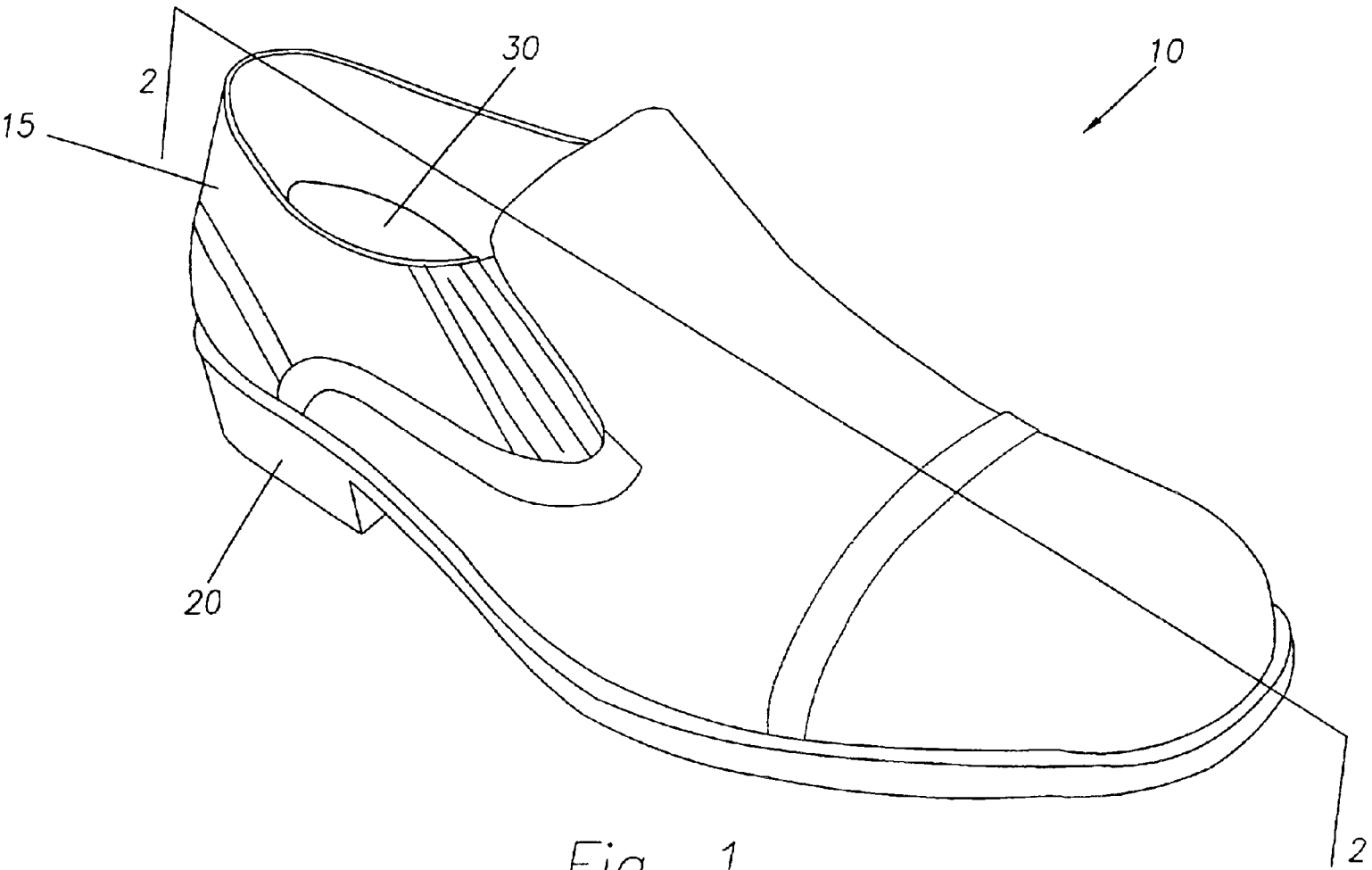
FIG. 1 is a perspective view of the improved dress shoe with a heel counter insert of the present invention.

Referring to the figures and in particular FIG. 1, there is provided a dress shoe of the present invention generally represented by numeral 10. Shoe 10 includes an upper 15, a sole 20 connected preferably directly to the upper and a forefoot portion 25 also preferably connected to the upper, opposite the sole.

Shoe 10 also may include an insole cushion 30 that can be disposed on an inner surface of upper 15. One skilled in the art should appreciate that any suitable insole cushion 30 known in the art may be used with shoe 10 of the present invention.

Figure 2:
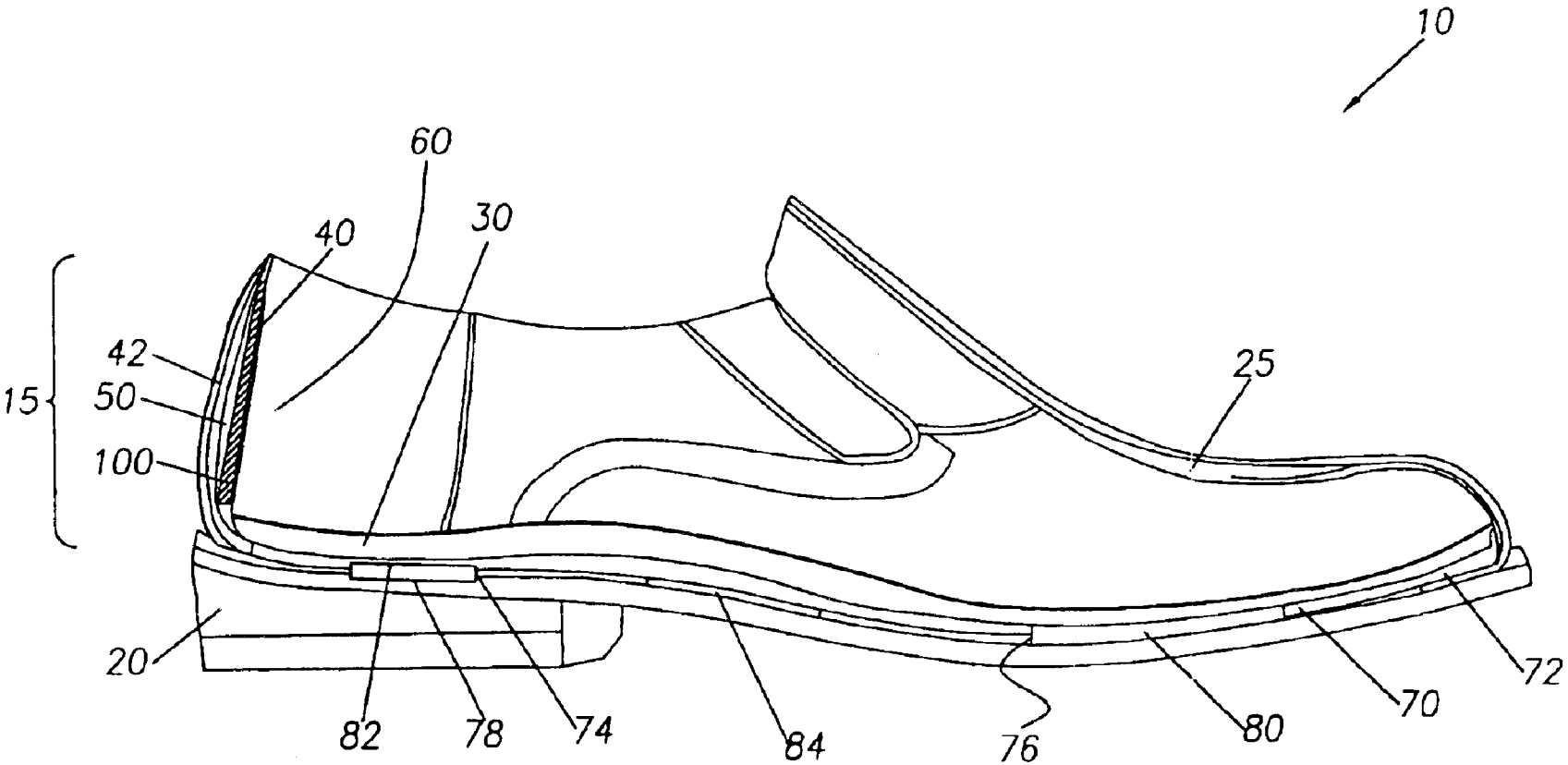
FIG. 2 is a cross sectional view of the improved dress shoe of FIG. 1 along line 2—2.

Referring to FIG. 2, a cross sectional view of the shoe 10 of the present invention is shown along line 2—2. The upper 15 of the present invention is formed by predominately two sections that overlie one another. The two sections are a first portion 40 and a second portion 42. An exemplary aspect of first portion 40 and second portion 42 is that they both form the upper 15 and surround the outer periphery of a heel of the wearer. Upper 15 may also include closure means (not shown) for securely positioning the upper on a foot and for adding support to the anterior of the foot disposed in the upper.

The first portion 40 and the second portion 42 may be connected to one another by any method known in the art. Such methods include, but are not limited to, adhesive, stitching or heat bonding. Also, first portion 40 and second portion 42 may be formed as one unitary member.

The first portion 40 and the second portion 42 are joined to define a heel pocket 50 therebetween disposed adjacent to the heel of the wearer. Heel pocket 50 is a longitudinally sized aperture. Heel pocket 50 can receive an intermediate layer or a heel counter insert 100 between the first portion 40 and the second portion 42. An exemplary aspect of the heel pocket 50 is that the heel pocket is formed in spaced relation to the heel or more specifically the calcaneus bone of a wearer.

An exemplary aspect of the present invention is that the heel counter insert 100 is disposed in the heel counter pocket 50. Preferably, insert 100 is made from Roger's Corporation® slow recovery polyurethane padding. Insert 100 has a slow recovery when pressure is applied to the insert 100, yet when released, returns to its original shape. This particular resilient material also provides resistance against extra shock and load, and provides support to the heel area of the foot. Insert 100 has a resiliency such that the insert recovers to its original shape instantly after being compressed, or has a resiliency that recovers to its original shape at a slow rate of recovery. However, insert 100 may be fashioned from any suitable material that exhibits resiliency, softness and deforms in response to the application of a load, while, after the load or force is removed, the material will return to its original, initial shape.

Insert 100 may have a density of 15 pounds per cubic foot. Insert 100 may also have a firmness described as a compression force deflection firmness of 4.5 pounds per square inch, or more particularly about 4.5 pounds per square inch will compress the insert about twenty five per cent. Insert 100 also has a compression set that is ASTM 1667 at seventy-three degrees Fahrenheit of less than five percent. Insert 100 also has a compression set measured at ASTM 3574 at one hundred fifty eight degrees for twenty-two hours of less than ten percent. Insert 100 may also have a tensile strength measured at ASTM D412 at a 20-inches/minute strain rate of 25 pounds per square inch as above 100 percent.

Insert 100 may extend around the heel periphery of the upper 15 around the calcaneus bone of the wearer. Insert 100 may be made of polyurethane, a slow recovery polyurethane, an ethyl vinyl acetate, a slow recovery ethyl vinyl acetate, or any combinations thereof. Insert 100 takes a predetermined amount of time to recover to its original thickness after compression.

An exemplary aspect of the present invention is that insert 100 may have a thickness in a range of about 1 mm to about 3 mm, preferably about 2.5 mm plus or minus about ten percent. However any suitable thickness of insert 100 may also be used in the dress shoe of the present invention. The insert 100 when disposed in heel counter pocket 50 deforms yet maintains resiliency to provide comfort to the foot disposed in the dress shoe. The deformation of insert 100 does not crowd the foot and provides increased comfort and support and comfortable fitting of shoe 10.

The first portion 40 may be made from a sueded reverse leather, a pigskin or any other suitable material known in the art for accomplishing the same to provide comfort to the wearer's foot disposed within the dress shoe 10 of the present invention. The second portion 42 may be made from an aesthetically pleasing full grain leather material or any suitable material known in the art.

An exemplary aspect of the interior of the first portion 40 is that the first portion has an interior textured surface 60. Textured surface 60 may be disposed around the periphery of the heel of the wearer. Textured surface 60 allows the wearer's foot, when disposed within shoe 10, to grab onto first portion 40 to cooperate with the heel counter insert 100 for an improved fitting of dress shoe.

It should be appreciated by one skilled in the art, that insert 100 may be used with any dress shoe known in the art. In preferred embodiment of the present invention, insert 100 may be used with an upper 15 that includes a portion 25 that is flexible for increased comfort. Flexible portion 25 may be formed having an ethyl vinyl acetate lining or any other suitable lining to cooperate with insert 100 to provide increased comfort and provide support to the foot disposed in shoe 10.

Heel counter insert 100 may also be fashioned into a number different shapes to further comfort the user. Insert 100 may also be formed as an arcuate shaped insert. Insert 100 may be arcuate to match the peripheral arc or curve of the wearer's heel. Insert 100 may be rectangular, oblong, elliptical, circular, triangular or any shape for approximating the curve or arch of the wearer's heel disposed in the dress shoe 10.

In an exemplary embodiment of the present invention, the insert 100 may be disposed in the heel pocket 50 and attached to first portion 40. Alternatively, the insert 100 may be disposed in the heel pocket 50 connected to second portion 42 or both the first portion and the second portion by stitching known in the art. However, any known methods for connecting insert 100 to either first portion 40 and/or second portion 42, while being disposed in the heel pocket 50, including adhesive, cement, heat bonding, fasteners, glue, may be utilized in the present invention.

Insert 100 may also be disposed floating between the first portion 40 and the second portion 42. The insert 100 may be encapsulated therebetween in spaced relation to heel without being connected to either first portion 40 or second portion 42 of upper 15.

The sole 20 may preferably be made from a flexible rubber or synthetic material. The sole 20 may be formed of a durable rubber, wood, or a urethane with a shore A durometer hardness. However, one skilled in the art should appreciate that sole 20 may be any sole known in the art.

Referring again to FIG. 2, shoe 10 may also have an inner sole 70 disposed on a top side of the sole 20. The inner sole 70 has a front portion 72 and a rear portion 74, the rear portion and the front portion each having one or more cavities 76, 78. The one or more cavities 76, 78 are adapted to receive a first layer of cushioning material 80 and a second layer of cushioning material 82 therein. The first layer of cushioning material 80 and the second layer of cushioning material 82 may be secured to the inner sole 70 and coincides or align vertically in the one or more cavities 76, 78. The first layer of cushioning material 80 and the second layer of cushioning material 82 may be made from ethyl vinyl acetate, polyurethane, a Poron or any other suitable cushioning material known in the art. A shank 84 may also be disposed in the inner sole 70, preferably along a longitudinal axis of the inner sole between the one or more cavities 76, 78 for increased support. Shank 84 may be a rectangular member disposed in a third cavity in the inner sole 70.

The present invention having been thus described with particular reference to the preferred forms thereof, it will be obvious that various changes and modifications may be made therein without departing from the spirit and scope of the present invention as defined in the appended claims.

What is claimed is:

1. A shoe comprising:

an upper having a first portion and a second portion, said first portion being connected to said second portion to define a heel counter pocket, said first portion and said second portion being connected to a foot bed; and a heel counter insert being positioned in said heel counter pocket, said heel counter insert being positioned in spaced relation to a calcaneus bone of a wearer, wherein said heel counter insert provides comfort to said wearer and improved fitting of the shoe, wherein said heel counter insert is a material selected from the group consisting of Poron, a slow recovery ethyl vinyl acetate, and any combinations thereof.

2. A shoe comprising:

an upper having a first portion and a second portion, said first portion being connected to said second portion to define a heel counter pocket, said first portion and said second portion being connected to a foot bed; and a heel counter insert being positioned in said heel counter pocket, said heel counter insert being positioned in spaced relation to a calcaneus bone of a wearer, wherein said heel counter insert provides comfort to said wearer and improved fitting of the shoe, wherein said heel counter insert is a slow recovery polyurethane.

3. The shoe of claim 1, wherein said heel counter insert has a thickness in a range of about 1 mm to about 3 mm.

4. The shoe of claim 3, wherein said thickness is in a range about 2 mm to about 3 mm.

5. The shoe of claim 3, wherein said thickness is about 2.5 mm.

6. The shoe of claim 1, wherein said first portion is a sueded reverse leather.

7. The shoe of claim 1, wherein said second portion is a full grain upper leather.

8. The shoe of claim 1, wherein said heel counter insert has an initial shape and a deformed shape, and wherein said heel counter insert deforms from said initial shape in response to said heel when said wearer wears the shoe and recovers to said initial shape when said wearer is not wearing the shoe.

9. The shoe of claim 1, further comprising a forepart portion connected to said upper.

10. The shoe of claim 9, wherein said forepart portion is flexible.

11. The shoe of claim 1, wherein said heel counter insert is arcuate in response to an arc of a heel of a wearer.

12. The shoe of claim 1, wherein said heel counter insert extends laterally around a periphery of a heel of said wearer.

13. The shoe of claim 1, wherein said heel counter insert is connected to said first portion and said second portion.

14. The shoe of claim 1, wherein said heel counter insert is connected to said first portion and said second portion by a method selected from the group consisting of a stitch operation, cementing, adhesive, a heat bonding operation, and any combinations thereof.

15. The shoe of claim 1, wherein said first portion is integrally connected to said heel counter insert.

16. The shoe of claim 1, wherein said second portion is integrally connected to said heel counter insert.

17. The shoe of claim 1, wherein said first portion and said second portion are integrally connected to said heel counter insert, and wherein said heel counter insert is positioned between said first portion and said second portion.

18. The shoe of claim 1, wherein said heel counter insert has a shape selected from the group consisting of an elliptical shape, a circular shape, a triangular shape, an oblong shape, a rectangular shape, an arcuate shape, and a shape that substantially approximates curve of a heel of said wearer disposed in the shoe.

19. The shoe of claim 1, wherein the shoe is a dress shoe.

20. The shoe of claim 1, wherein the shoe is an athletic shoe.

21. The shoe of claim 1, wherein the shoe is a boot.

22. A shoe comprising:

an upper having a first portion and a second portion, said first portion being connected to said second portion to define a heel counter pocket, said heel counter pocket being between said first portion and said second portion; and a heel counter insert being made from a material selected from the group consisting of Poron, a slow recovery ethyl vinyl acetate, a slow recovery polyurethane, and any combinations thereof, said heel counter insert being in said heel counter pocket in spaced relation to a heel of a wearer, wherein said heel counter insert provides comfort to said wearer and improved fitting of the shoe.

23. A shoe comprising:

a heel counter insert being made from a material selected from the group consisting of Poron, a slow recovery ethyl vinyl acetate, a slow recovery polyurethane and any combinations thereof, said heel counter insert being in a heel counter pocket in spaced relation to a heel of a wearer, said heel counter pocket being formed by an upper having a first portion connected to a second portion, said heel counter insert having a thickness in a range of about 1 mm to about 3 mm, wherein said heel counter insert provides comfort to said wearer and improved fitting of the shoe.

24. A dress shoe comprising:

a foot bed;

an upper having a first portion and a second portion, said first portion being connected to said second portion to define a heel counter pocket, said first portion and said second portion being connected to said foot bed;

a first heel counter insert being positioned in said heel counter pocket, said first heel counter insert being made from a durable and resilient material having a first hardness, said first heel counter insert for maintaining a shape of a rear of the dress shoe; and a second heel counter insert being connected to said first heel counter insert in said heel counter pocket, said second heel counter insert being connected to said second heel counter insert forming a laminate structure, wherein said second heel counter insert faces a wearer's foot when in the dress shoe, wherein said second heel counter insert is made from a slow recovery polyurethane, said slow recovery polyurethane being made with a second hardness softer than said first hardness, wherein said second heel counter insert is positioned in spaced relation to a calcaneus bone of a wearer, and wherein said second heel counter insert provides comfort to said wearer and improved fitting of the dress shoe.

* * * * *